US007066327B2

(12) United States Patent
Baublitz et al.

(10) Patent No.: US 7,066,327 B2
(45) Date of Patent: Jun. 27, 2006

(54) SAW BLADE PACKAGING

(75) Inventors: Leonard R. Baublitz, Manchester, MD (US); Ehren C. Staudt, Schnecksville, PA (US); Jonathan S. Leyfert, Bath, PA (US)

(73) Assignee: Black & Decker Inc., Newark, DE (US)

( * ) Notice: Subject to any disclaimer, the term of this patent is extended or adjusted under 35 U.S.C. 154(b) by 130 days.

(21) Appl. No.: 10/738,363

(22) Filed: Dec. 17, 2003

(65) Prior Publication Data

US 2005/0133389 A1 Jun. 23, 2005

(51) Int. Cl.
*A45C 11/26* (2006.01)

(52) U.S. Cl. ..... 206/349; 206/303; 206/493; 206/467

(58) Field of Classification Search ..... 206/349, 206/303, 493, 467, 308.1, 309–312, 372, 206/373; D6/407; D3/315; D9/415
See application file for complete search history.

(56) References Cited

U.S. PATENT DOCUMENTS 2,601,426 A * 6/1952 Baumann ..... 206/349
4,588,082 A 5/1986 Ridings
5,078,266 A * 1/1992 Rackley ..... 206/349
5,476,173 A * 12/1995 Opresco ..... 206/309
5,477,960 A * 12/1995 Chen ..... 206/308.1
5,529,182 A 6/1996 Anderson et al.
5,611,426 A * 3/1997 Warfield ..... 206/308.1
5,743,390 A * 4/1998 Pozzoli ..... 206/232
5,785,172 A 7/1998 Bolognia et al.
5,950,821 A * 9/1999 Moser ..... 206/308.1
6,161,689 A 12/2000 Reithel
6,164,447 A 12/2000 Svetlik
6,267,239 B1 * 7/2001 Maki ..... 206/349
6,401,922 B1 6/2002 Svetlik
6,427,832 B1 8/2002 Ali et al.
D486,668 S * 2/2004 Bird et al. ..... D6/407
6,837,370 B1 * 1/2005 Shindo et al. ..... 206/308.1
6,868,966 B1 * 3/2005 German, III ..... 206/349

* cited by examiner

*Primary Examiner*—Jila M. Mohandesi
(74) *Attorney, Agent, or Firm*—Harness, Dickey & Pierce, P.L.C.

(57) ABSTRACT

A display package for presenting saw blades includes a first blister portion having a first extension portion. A second blister portion is coupled to the first blister portion and defines an inner space therebetween. The second blister portion includes a second extension portion. A first disk shaped article is disposed in the first extension portion. A second disk shaped article is disposed in the second extension portion. A separator is disposed in the inner space between the first and second articles.

29 Claims, 6 Drawing Sheets

SAW BLADE PACKAGING

FIELD OF THE INVENTION

The present invention relates to packaging for displaying articles and more particularly to displaying saw blades in an offset relationship.

BACKGROUND OF THE INVENTION

Circular saw blades are typically offered for sale in protective packaging. Typically, the saw blades are presented in the protective packaging hanging on a display rack or standing upright on a shelf. The saw blades may be individually packaged or packaged as a multi-pack.

Often a customer is interested in purchasing more than one blade at a time. For instance, a given project may require the use of a fast cutting blade and a finishing blade for example. Sometimes, it is convenient to compare the tooth pattern or other features between such blades. If the blades are packaged singularly, a customer is required to retrieve each desired package for comparison. When blades are offered as part of a multi-pack, the blades are typically stacked, and as a result, it is often difficult to view the features of each blade.

SUMMARY OF THE INVENTION

A display package includes a first blister portion having a first extension portion. A second blister portion is coupled to the first blister portion and defines an inner space therebetween. The second blister portion includes a second extension portion. A first disk shaped article is disposed in the first extension portion. A second disk shaped article is disposed in the second extension portion. A separator is disposed in the inner space between the first and second articles.

According to other features, the separator includes a first hub arranged thereon extending into the first extension portion and cooperatively engaged with the first blister portion. The separator includes a second hub accepter arranged thereon extending into the second extension portion and cooperatively engaged with a second hub disposed on the second blister portion. The first and second extension portion are laterally offset relative to one another to enable simultaneous viewing of the first and second disk shaped article through the first blister portion. The first extension portion includes a stopper extending into the inner space for engaging the first disk shaped article and precluding the first disk shaped article from rotating. Similarly, the second extension portion includes a stopper extending into the inner space for engaging the second disk shaped article and precluding the second disk shaped article from rotating.

According to other features, an insert card is disposed in the inner space. The insert card includes a first portion positioned at least partially on a first side of the first disk shaped article. A second portion is positioned at least partially on a first side of the first disk shaped article. A connecting portion extends between the first and second portion at a periphery of the first disk shaped article.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
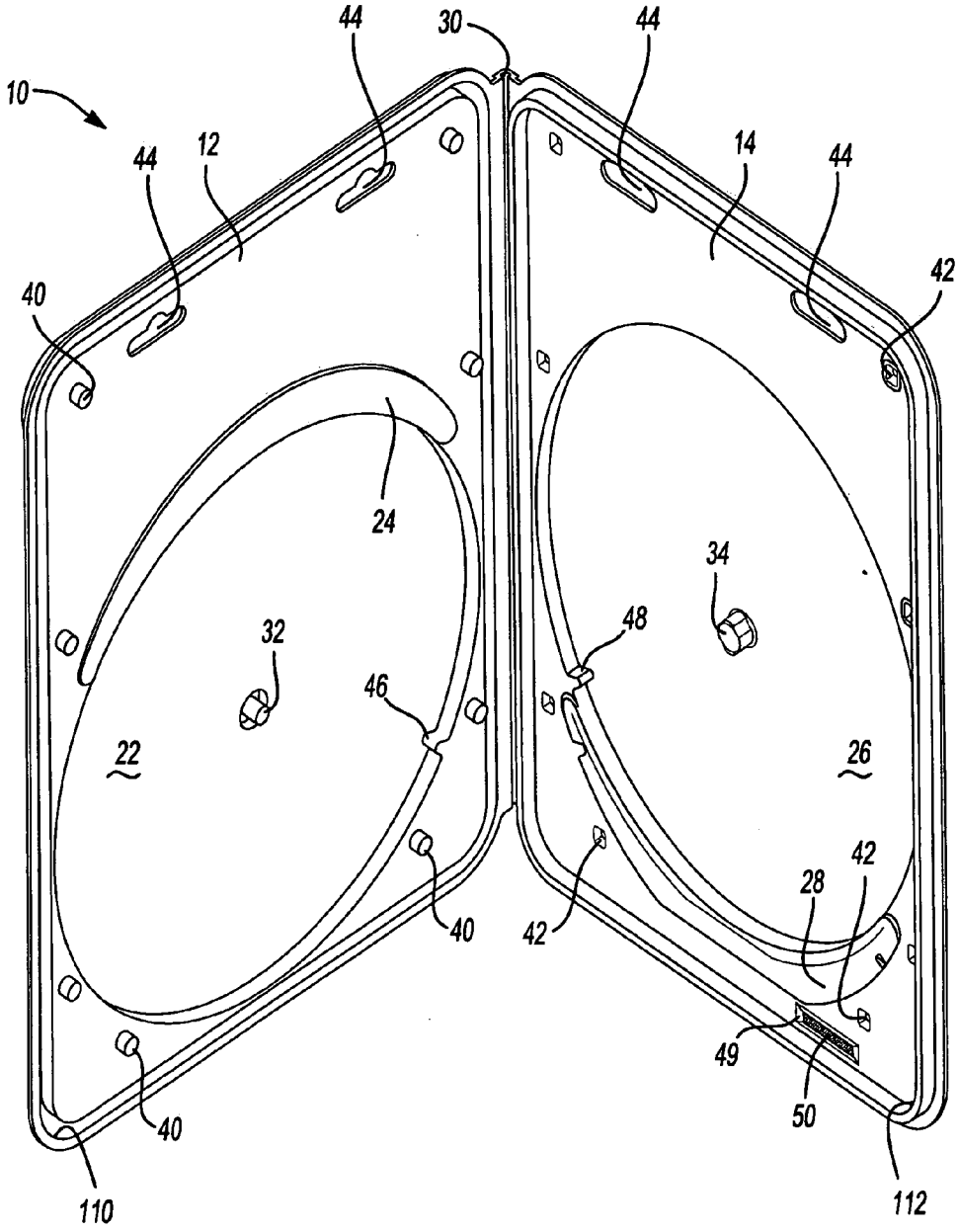
FIG. 1 is a perspective view of the saw blade packaging according to the principles of the present invention.
Figure 2:
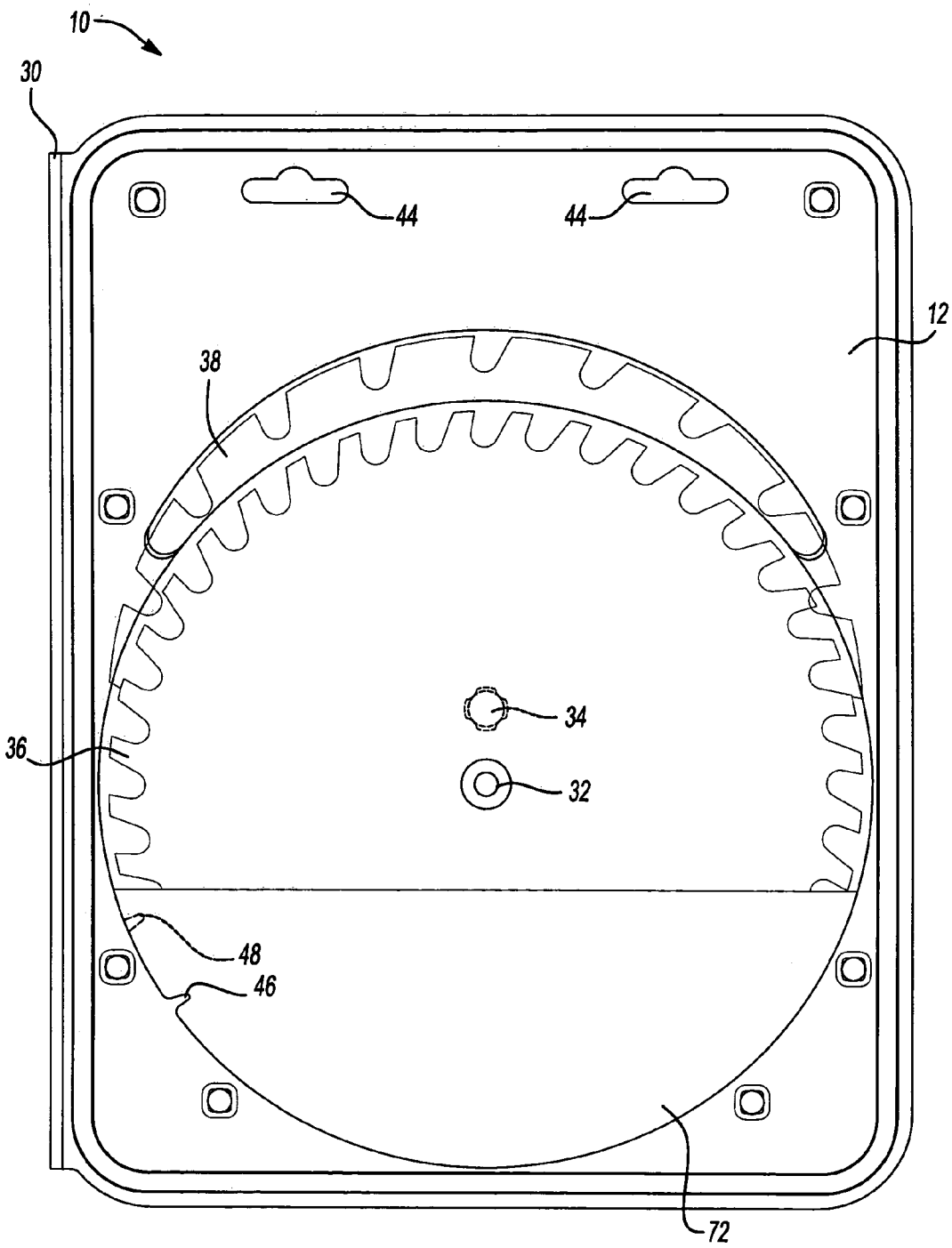
FIG. 2 is a front view of the saw blade packaging shown in an assembled position.
Figure 3:
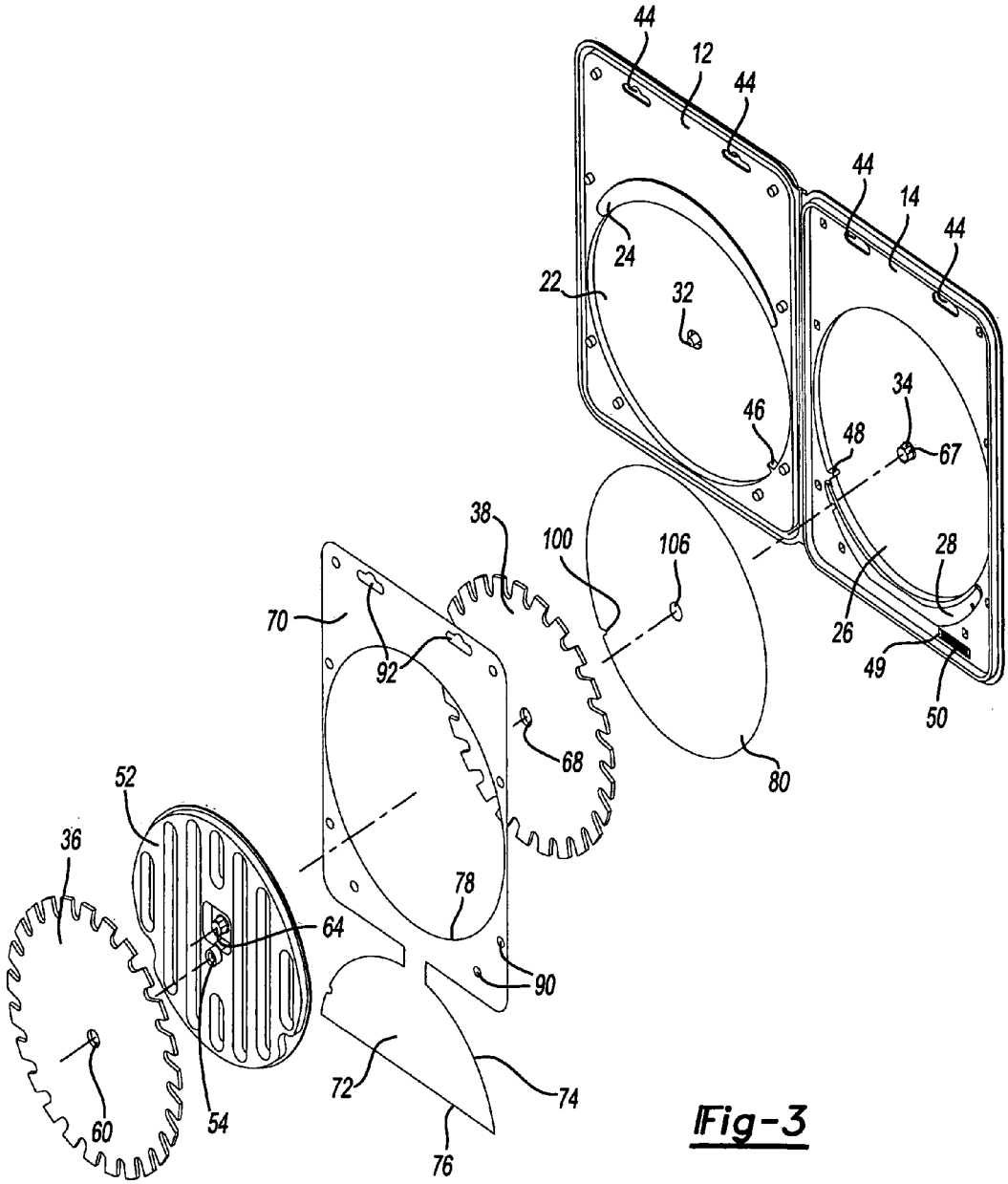
FIG. 3 is an exploded view of the saw blade packaging.

With initial reference to FIGS. 1–3 a display package for presenting saw blades according to the present invention-is shown and generally identified by reference numeral 10. The display package 10 generally includes a front blister portion 12 and a rear blister portion 14. The front blister portion 12 includes a front extension portion 22 and an adjacent front recess portion 24. The rear blister portion 14 includes a rear extension portion 26 and a rear recess portion 28. The front blister portion 12 and the rear blister portion 14 are coupled together at a common edge 30 that operates as a living hinge for rotating the front blister portion 12 relative to the rear blister portion 14. The front and rear blister portion 12 and 14 are preferably comprised of transparent plastic.

A front hub connector 32 centrally extends from the front recess portion 22. A rear hub 34 centrally extends from the rear extension portion 26. As will be described herein, the front hub connector 32 and the rear hub 34 define laterally offset mounting axes for receiving a respective front and rear saw blade 36 and 38. A plurality of male pegs 40 extend from the front blister portion 12 and are received by complementary female slots 42 arranged along the rear blister portion 14 in an assembled position (FIG. 2). Hanging apertures 44 are arranged at the top of the front and rear blister portions 12 and 14. A stopper 46 is arranged around the perimeter of the front extension portion 22 for cooperating with the front blade 36 to prevent rotation within the package 10. Similarly, a stopper 48 is incorporated on the rear extension portion 26 for precluding rotation of the rear blade 38 while in the rear extension portion 26. A cavity 49 is incorporated on the rear blister portion 14 and includes an anti-theft device 50 disposed therein.

With specific reference now to FIG. 3, the display package 10 further comprises a separator 52 disposed between the front blade 36 and the rear blade 38. A front hub 54 cooperatively engages the front hub connector 32 of the front blister portion 12. More specifically, the front hub connector 32 is received by and maintains a clearance fit with a relief 58 (FIG. 6) formed on the front hub 54. The front hub 54 extends through a mounting hole 60 in the front saw blade 36.

A rear hub acceptor 64 extending rearwardly from the separator 52, cooperatively engages the rear hub 34 of the rear blister portion 14. More specifically, the rear hub 34 is received by the rear hub acceptor 64. A series of concave portions 66 (FIG. 6) cooperatively interfit within a complementary series of convex portions 67 (FIG. 3) on the rear hub 34 to further secure the separator 52 to the rear blister portion 14 and to preclude rotation of the separator 52 about the rear hub 34. The rear hub 34 extends through a mounting hole 68 in the rear saw blade 38.

An insert card 70 is positioned between the front and the rear blade 36 and 38. A semi-circular flap 72 is incorporated on a lower portion of the insert card 70. The semi-circular flap 72 is generally defined by a radial boundary 74 and a linear portion 76. The insert card 70 includes a central passage 78 to allow viewing of the rear blade 38. An information card 80 is disposed between the rear blister portion 14 and the rear blade 38 in the rear extension portion 26.

Figure 4:
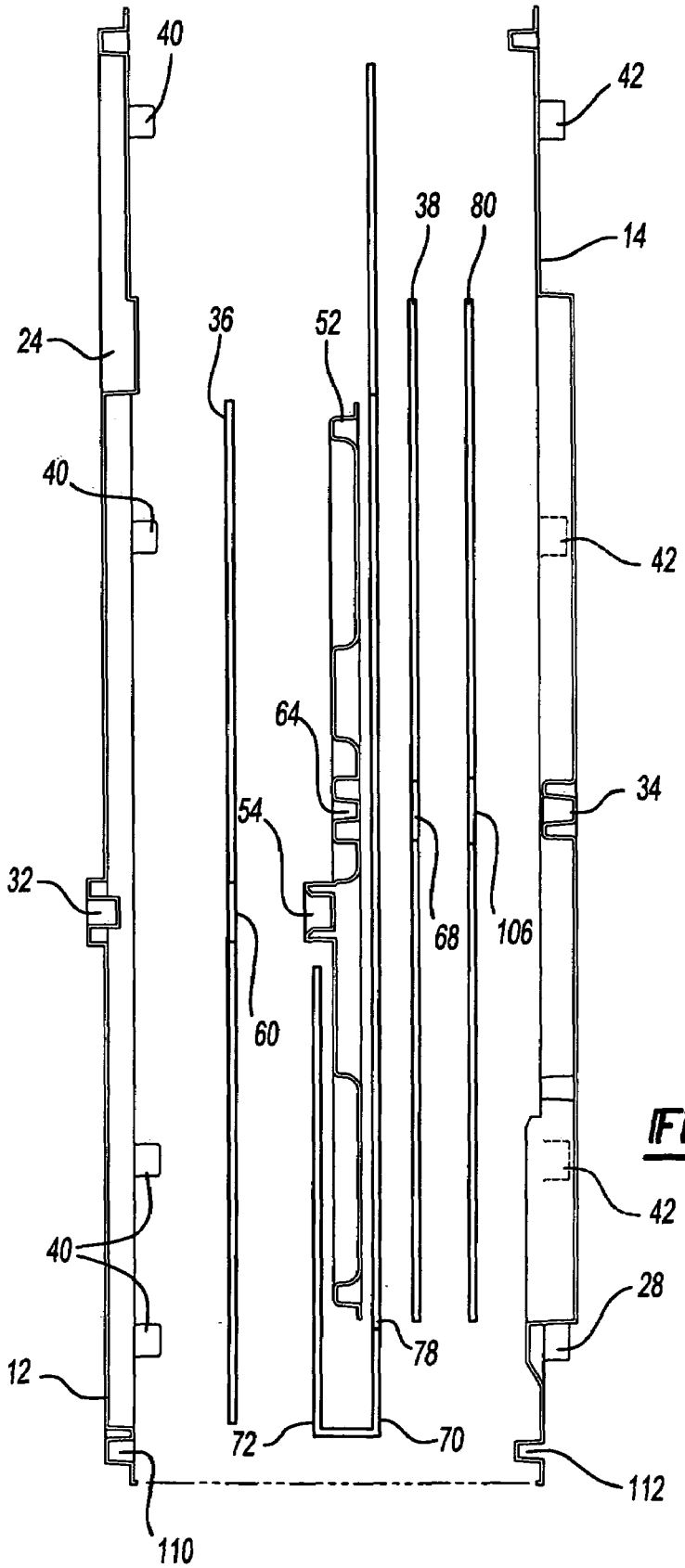
FIG. 4 is an exploded sectional view of the saw blade packaging taken vertically along the front and rear hubs.

As shown most clearly in FIGS. 2 and 4, the display package presents the front and the rear blade 36 and 38 in an offset relationship to allow each blade 36 and 38 to be simultaneously viewed through the front blister portion 12. The front hub 54 and the rear hub 34 are laterally offset in the vertical direction. The front recess portion 24 coincides with the overlap presented by the offset hubs 34 and 54. In this way, a portion of the upper radial surface of the rear blade 38 may be viewed through the front recess portion 24 (FIG. 2).

Figure 5:
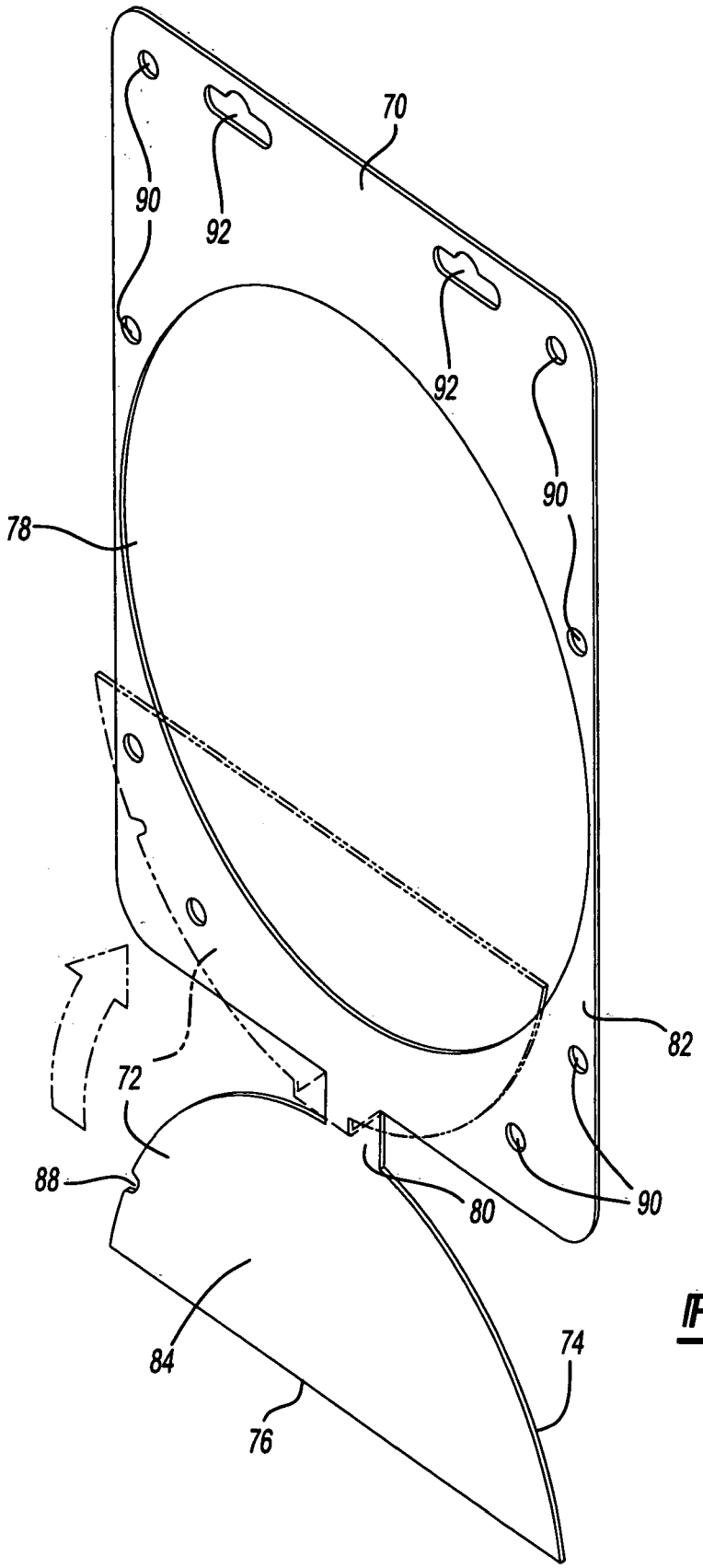
FIG. 5 is a perspective view of the insert card of the saw blade packaging shown in the unfolded position as a solid line and in the folded position as a phantom line.

Turning now to FIG. 5, the insert card 70 will be described in further detail. The insert card 70 is shown in solid line in the unfolded position. A connecting portion 80 extends between a rear portion 82 and a front portion 84. In the assembled position (FIG. 2), the flap 72 (front portion 84) is folded into a generally parallel speed relationship with the rear portion 82. As a result, the connecting portion 80 occupies a generally perpendicular relationship with the flap 72 and the rear portion 82. In this way, the connecting portion 80 accommodates the depth 72 sufficient to accommodate the front blade 36 in the assembled position. A notch 88 is provided in the flap 72 for aligning with the stopper 46 incorporated on the front blister portion 12.

In the assembled position, the front blade 36 covers at least a section of the rear portion 82 of the insert card 70. The insert card 70 further includes apertures 90 arranged to coincide with the pegs 40 incorporated on the front blister portion 12. Mounting passages 92 are provided at the top of the rear portion 82 and coincide with the passages 44 on the front and the rear blister portions 12 and 14.

Figure 6:
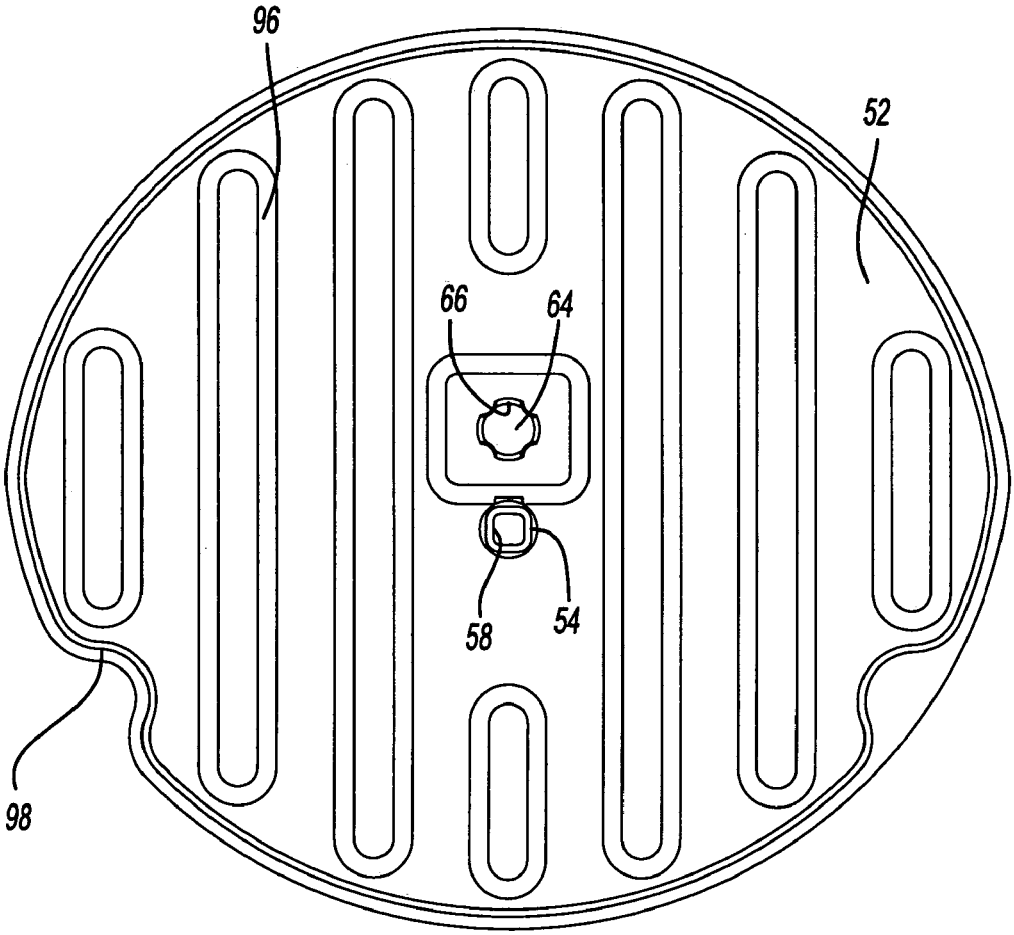
FIG. 6 is a front view of a separator plate of the saw blade packaging.

With reference now to FIG. 6, the separator 52 will be described in further detail. The separator 52 is generally circular or oval having an outer dimension capable of fitting within the boundary of the front extension portion 22 and the rear extension portion 26. A plurality of ridges 96 are incorporated along the surface of the separator 52. The ridges define a depth for offsetting the front blade 36 and the rear blade 38 and further increase structural ridigity of the separator 52. A relief portion 98 is arranged around the perimeter of the separator 52 for aligning with the stopper 46 of the front blister portion 12. The separator 52 is preferably comprised of transparent plastic.

With specific reference again to FIG. 3, the information card 80 will be described. The information card 80 is generally circular and incorporates a notch portion 100 for aligning with the stopper 48 incorporated on the rear blister portion 14. The stopper 48 and the notch portion 100 cooperate to maintain the information card 80 in a desired orientation. The information card 80 may contain product information, instruction or other text.

With reference now to all the drawings, assembly of the display package will now be described. The front and rear blister portion 12 and 14 are first presented in an opened orientation (FIG. 1). The information card 80 is then placed into the rear extension portion 26 by aligning a central aperture 106 of the information card 80 with the rear hub 34 of the rear blister portion 14. The notch 100 of the information card 80 is then oriented to receive the stopper 48 of the rear blister portion 14. The rear blade 38 is then placed within the rear extension portion 26 by aligning the central aperture 68 of the rear blade 38 with the rear hub 34. The stopper 48 extending from the rear extension portion 26 of the rear blister portion 14 is located between adjacent teeth arranged around the rear blade 38. If desired, the rear blade 38 can be placed in the rear extension portion 26 with a desired orientation so that a desired text or indicia on the rear blade 38 are visible.

Next, the separator 50 is placed over the rear blade 38. As previously described, the rear hub accepter 64 of the separator 52 is disposed around the rear hub 34 in an engaged position. Next, the insert card 70 is placed over the rear blister portion 14 in an unfolded orientation. The front blade 36 is subsequently located onto the front hub 54 of the separator 52. The flap 72 is then folded to cover a portion of the front blade 36. The front blister portion 12 is then folded about the common edge 30 so that the slots 42 of the rear blister portion 14 receive the pegs 40 extending from the front blister portion 12. The stopper 46 extending from the front extension portion 22 of the front blister portion 12 is located between adjacent teeth arranged around the front blade 36. Complementary outer channels 110 and 112 (FIG. 1) formed around the front blister portion 12 and the rear blister portion 14, respectively, are press fit together and are then thermoformed or otherwise adhered.

The invention being thus described, it will be obvious that the same may be varied in many ways. Although the preceding discussion is directed toward a package for displaying saw blades, the same may be used to display other disk shaped articles. Likewise, the display package described may be adapted to contain more than two saw blades by incorporating additional separators and modifying the front and rear blister portions 12 and 14 accordingly to accept additional saw blades. Such variations are not to be regarded as a departure from the spirit and scope of the invention, and all such modifications as would be obvious to one skilled in the art are intended to be included within the scope of the following claims.

What is claimed is:

1. A display package comprising:

a first blister portion having a first extension portion;

a second blister portion coupled to said first blister portion and defining an inner space therebetween, said second blister portion having a second extension portion;

a first disk shaped article disposed in said first extension portion;

a second disk shaped article disposed in said second extension portion; and a separator disposed in said inner space between said first and second articles said separator including a first hub arranged thereon extending into said first extension portion and cooperatively coupled with a hub connector formed on said first blister portion, said first hub received through a mounting aperture of said first disk shaped article.

2. The package of claim 1 wherein said separator includes a second hub acceptor arranged thereon extending into said second extension portion and cooperatively engaged with a second hub disposed on said second blister portion.

3. The package of claim 2 wherein said second disk shaped article includes a mounting aperture for receiving said second hub.

4. The package of claim 1 wherein said first and second extension portion are laterally offset relative to one another to enable simultaneous viewing of said first and second disk shaped article through said first blister portion.

5. The package of claim 1 wherein said first and second hubs are laterally offset relative to one another.

6. The package of claim 1 wherein said first extension portion includes a first hub connector extending into said inner space and engaging said first hub.

7. The package of claim 1 wherein said first extension portion includes a stopper extending into said inner space for engaging said first disk shaped article and precluding said first disk shaped article from rotating.

8. The package of claim 1 wherein said second extension portion includes a stopper extending into said inner space for engaging said front disk shaped article and precluding said second disk shaped article from rotating.

9. The package of claim 1 wherein said first and second disk shaped articles include saw blades.

10. The package of claim 1, further comprising an anti-theft sensor disposed in said inner space.

11. The package of claim 1 wherein said first and second blister portions are thermoformed together at least around a portion of a perimeter thereof.

12. A display package comprising:

a first blister portion having a first extension portion;

a second blister portion coupled to said first blister portion and moveable between opened and closed positions and defining an inner space therebetween, said second blister portion having a second extension portion laterally offset from said first extension portion;

a first disk shaped article disposed in said first extension portion;

a second disk shaped article disposed in said second extension portion whereby said laterally offset extension portions provide simultaneous viewing of respective first and second disk shaped articles through one of said first and second blister portions in said closed position; and a separator disposed in said inner space between said first and second disk shaped articles, said separator comprising a first hub arranged thereon extending into said first extension portion.

13. The display package of claim 12 wherein said second blister portion includes a second hub arranged thereon extending into said second extension portion.

14. The display package of claim 13 wherein said first hub is laterally offset from said second hub.

15. The display package of claim 13 wherein said first disk shaped article includes a mounting aperture for receiving said first hub and said second disk shaped article includes a mounting aperture for receiving said second hub.

16. The display package of claim 15 wherein said first extension portion includes a first hub connector extending into said inner space and engaging said first hub, and wherein said separator includes a second hub acceptor for engaging said second hub.

17. The display package of claim 16 wherein said first extension portion defines a first radius having a first centerpoint and said second extension portion defines a second radius having a second centerpoint laterally offset from said first centerpoint, wherein said first hub is axially aligned with said first centerpoint and said second hub is axially aligned with said second centerpoint.

18. The display package of claim 12 wherein said first extension portion includes a stopper extending into said inner space for engaging said first disk shaped article and precluding said first disk shaped article from rotating.

19. The display package of claim 12 wherein said second extension portion includes a stopper extending into said inner space for engaging said second disk shaped article and precluding said second disk shaped article from rotating.

20. The display package of claim 12 wherein said first and second disk shaped articles include saw blades.

21. The package of claim 12 wherein said first and second blister portions are thermoformed together around at least a portion of a perimeter thereof.

22. A display package comprising:

a first blister portion;

a second blister portion coupled to said first blister portion and defining an inner space therebetween;

a first disk shaped article disposed in said inner space; and a unitary insert card disposed in said inner space, said insert card comprising:

a first portion positioned at least partially on a first side of said first disk shaped article;

a second portion positioned at least partially on a second side of said first disk shaped article; and a connecting portion extending between said first and second portion and positioned at a periphery of said first disk shaped article wherein said connecting portion extends substantially perpendicularly to said first and second portions of said insert card, said connecting portion accommodating the depth of said first disk shaped article.

23. The display package of claim 22 wherein said first portion of said insert card includes a radial portion aligned with a radial boundary of said first disk shaped article and a linear portion extending between two points on said radial boundary of said first disk shaped article.

24. A display package comprising:

a first blister portion having a first extension portion;

a second blister portion coupled to said first blister portion and defining an inner space therebetween, said second blister portion having a second extension portion;

a first disk shaped article disposed in said first extension portion;

a second disk shaped article disposed in said second extension portion;

a first stopper integrally formed in said first extension portion at an outer circumferential boundary thereof, said first stopper extending to a fixed location inboard from said circumferential boundary into said inner space and cooperating with said first disk shaped article to preclude rotation thereof;

a second stopper formed in said second extension portion at an outer circumferential boundary thereof, said second stopper extending inboard from said circumferential boundary into said inner space and cooperating with said second disk shaped article to preclude rotation thereof;

a separator disposed in said inner space between said first and second disk shaped articles, said separator comprising a first hub arranged thereon extending into said first extension portion;

wherein said second blister portion includes a second hub, laterally offset from said first hub and extending from said second extension portion and cooperatively engaging a second hub acceptor disposed on said separator.

25. The display package of claim 24 wherein said first disk shaped article includes a mounting aperture for receiving said first hub and said second disk shaped article includes a mounting aperture for receiving said second hub.

26. The display package of claim 24 wherein said first and second disk shaped articles include saw blades and wherein said first and second stoppers extend between adjacent teeth disposed around respective first and second saw blades.

27. A display package comprising:

a first blister portion;

a second blister portion coupled to said first blister portion and defining an inner space therebetween;

a first disk shaped article disposed in said inner space; and a unitary insert card disposed in said inner space, said insert card comprising:

a first portion positioned at least partially on a first side of said first disk shaped article;

a second portion positioned at least partially on a second side of said first disk shaped article; and a connecting portion extending between said first and second portion and positioned at a periphery of said first disk shaped article wherein said connecting portion extends substantially perpendicularly to said first and second portions of said insert card, said connecting portion accommodating the depth of said first disk shaped article, and a second disk shaped article disposed in said inner cavity at a laterally offset relationship from said first disk shaped article.

28. The display package of claim 27 wherein said first blister portion of the package includes a first extension portion for receiving said first disk shaped article and said second blister portion of the package includes a second extension portion for receiving said second disk shaped article.

29. The display package of claim 28 wherein said second portion of said insert card occupies a peripheral area outside said second extension portion.

* * * * *